US012577018B2

(12) United States Patent
Wakimoto

(10) Patent No.: US 12,577,018 B2
(45) Date of Patent: Mar. 17, 2026

(54) PACKING FASTENER AND PACKING BOX COUPLED TOGETHER THEREWITH

(71) Applicant: KYOCERA Document Solutions Inc., Osaka (JP)

(72) Inventor: Atsuhiro Wakimoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 254 days.

(21) Appl. No.: 18/626,763

(22) Filed: Apr. 4, 2024

(65) Prior Publication Data

US 2024/0343444 A1 Oct. 17, 2024

(30) Foreign Application Priority Data

Apr. 14, 2023 (JP) ..... 2023-066362
Jan. 9, 2024 (JP) ..... 2024-001259

(51) Int. Cl.
*B65D 19/20* (2006.01)
*B65D 19/44* (2006.01)

(52) U.S. Cl.
CPC ..... *B65D 19/20* (2013.01); *B65D 19/44* (2013.01); *B65D 2519/00159* (2013.01);
(Continued)

(58) Field of Classification Search
CPC ..... B65D 19/38; B65D 19/44; B65D 19/20; B65D 19/06; B65D 69/00; B65D 5/12;
(Continued)

(56) References Cited

U.S. PATENT DOCUMENTS 6,412,153 B1 * 7/2002 Khachadourian ..... F16B 5/0664 24/625
7,240,406 B1 * 7/2007 Liverman ..... F16B 5/0642 24/614

(Continued)

FOREIGN PATENT DOCUMENTS

CN 213429519 U 6/2021
JP S 63-67246 A 3/1988

(Continued)

OTHER PUBLICATIONS

Chinese Office Action dated Dec. 8, 2025, issued by the China National Intellectual Property Administration in corresponding application CN 202410412906.8.

*Primary Examiner* — Daniel J Wiley
(74) *Attorney, Agent, or Firm* — Stein IP, LLC

(57) ABSTRACT

A packing fastener includes a base member and a key member. The base member includes: a first tubular portion; a flange portion provided on a first opening edge of the first tubular portion at one end; and a pair of hook members coupled to opposite inner side faces of the first tubular portion to be bent toward a second opening edge of the first tubular portion at the other end. The key member has a second tubular portion removably insertable in the first tubular portion via the first opening edge. The pair of hook members are, with no external force applied to it, arranged in a wedge shape as seen in a sectional view to be increasingly close to each other toward tip ends. An outer side face of the first tubular portion has a slope inclined inward from the first opening edge toward the second opening edge.

10 Claims, 9 Drawing Sheets

(52) U.S. Cl.
CPC ..... *B65D 2519/00194* (2013.01); *B65D 2519/00497* (2013.01); *B65D 2519/00537* (2013.01); *B65D 2519/00661* (2013.01); *B65D 2519/00815* (2013.01)

(58) Field of Classification Search
CPC . B65D 5/44; B65D 5/66; B65D 55/10; B65D 55/14; B65D 15/22
See application file for complete search history.

(56) References Cited

U.S. PATENT DOCUMENTS

| | | | | |
|---|---|---|---|---|
| 7,480,968 | B2 * | 1/2009 | Maresh | F16B 5/0642 24/453 |
| 7,870,653 | B2 * | 1/2011 | Maresh | H01P 1/387 24/614 |
| 7,908,719 | B2 * | 3/2011 | Liverman | F16B 5/0642 24/453 |
| 2015/0056011 | A1 * | 2/2015 | Nakamura | B65D 19/20 403/408.1 |
| 2021/0221559 | A1 * | 7/2021 | Wakimoto | F16B 21/086 |

FOREIGN PATENT DOCUMENTS

| | | | |
|---|---|---|---|
| JP | 2015-042560 | A | 3/2015 |
| JP | 2017-024726 | A | 2/2017 |
| TW | 201106832 | A1 | 2/2011 |

* cited by examiner

PACKING FASTENER AND PACKING BOX COUPLED TOGETHER THEREWITH

INCORPORATION BY REFERENCE

This application is based upon and claims the benefit of priority from the corresponding Japanese Patent Applications No. 2023-066362 filed on Apr. 14, 2023 and No. 2024-001259 filed on Jan. 9, 2024, the entire contents of which are hereby incorporated by reference.

BACKGROUND

The present disclosure relates to a packing fastener that is inserted in overlapping holes in two or more pieces of a packing material, such as cardboard sheets, so as to couple them together, and also relates to a packing box coupled together with such a packing fastener.

Conventionally, what is called a "C-type packing box" in which an article is placed on a lower box and an upper box is placed on top to secure it is widely used for packing a large and heavy article such as an electronic appliance.

There have been devised packing fasteners that can be easily removed from the coupled lower and upper boxes when unpacking such a C-type packing box.

SUMMARY

According to one aspect of the present disclosure, a packing fastener includes a base member and a key member. The base member includes: a first tubular portion that is inserted in overlapping through holes formed in two or more pieces of a packing material; a flange portion that is provided on a first opening edge of the first tubular portion at one end; a pair of hook members that are coupled via first hinge portions to opposite inner side faces of the first tubular portion to be bent, about the first hinge portions as hinge axes, outward of a second opening edge of the first tubular portion at the other end so as to face the flange portion. The key member has a second tubular portion that can be removably inserted in the first tubular portion of the base member via the first opening edge and that is coupled to the flange portion via a second hinge portion perpendicular to the first hinge portions. When the first tubular portion is inserted in the through holes starting with the second opening edge and then the second tubular portion is inserted in the first tubular portion, the hook members pivot about the first hinge portions as hinge axes toward the second opening edge of the first tubular portion to project out beyond the second opening edge, resulting in the two or more pieces of the packing material being held between the flange portion and the hook member. The pair of hook members are, with no external force applied to it, arranged in a wedge shape as seen in a sectional view so as to be increasingly close to each other toward tip ends. Each of opposite outer side faces of the first tubular portion has a slope that is inclined inward from the first opening edge toward the second opening edge.

DETAILED DESCRIPTION

Figure 1:
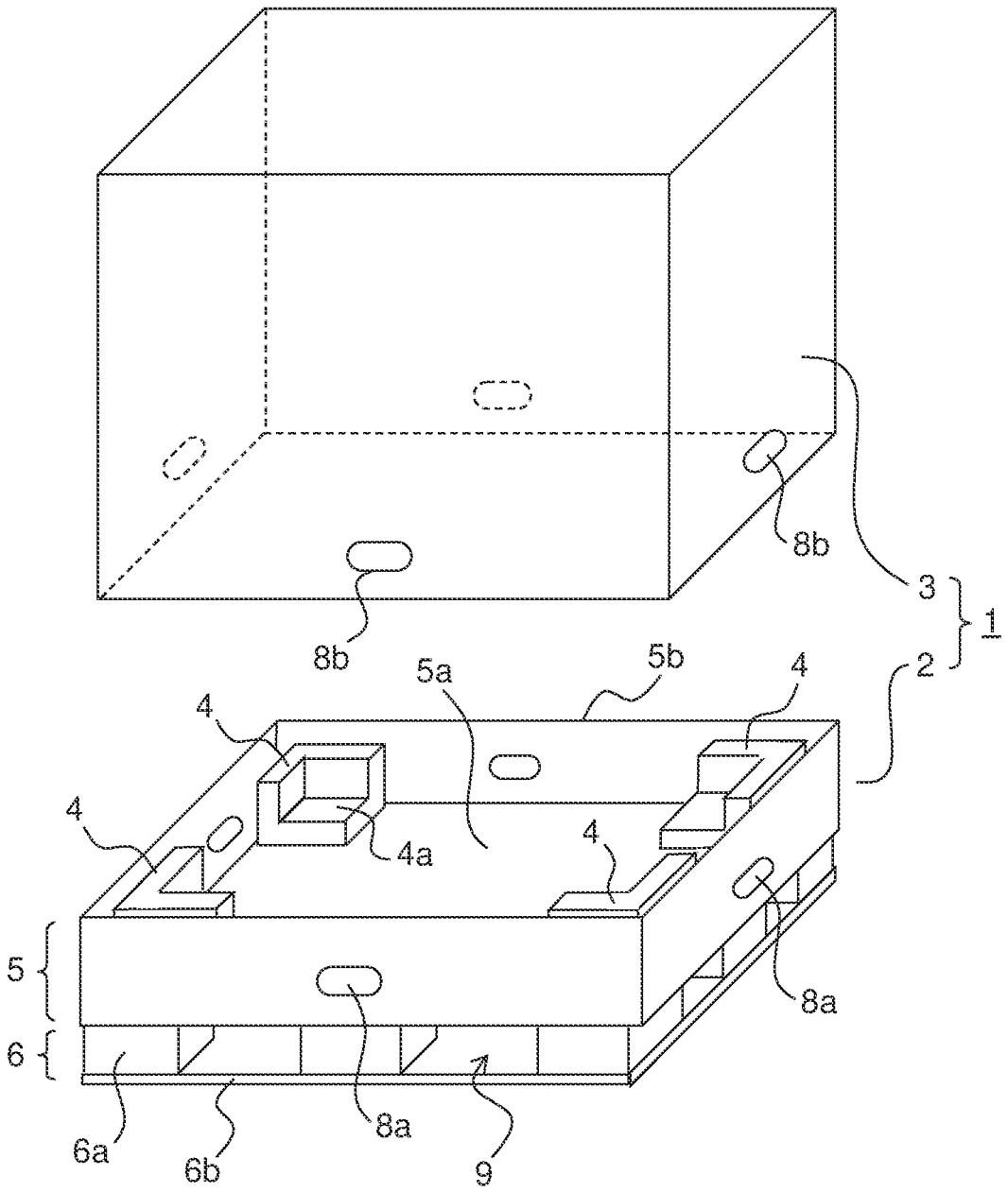
FIG. 1 is an exploded perspective view showing an example of the structure of a packing box to which a packing fastener according to the present disclosure is attached.

Hereinafter, with reference to the accompanying drawings, embodiments of the present disclosure will be described. FIG. 1 is a perspective view showing an example of the structure of a packing box 1 according to the present disclosure to which a packing fastener 10 is attached. The packing box 1 is composed of a pallet-with-tray 2, an upper box 3, and a shock absorber 4 arranged on the pallet-with-tray 2.

The pallet-with-tray 2 includes a tray 5 having a bottom face 5*a* on which an article to be packed (not shown) is placed and side walls 5*b* that rise from the circumference of the bottom face 5*a*, and a pallet 6 fixed to the bottom surface of the tray 5. The shock absorber 4 is arranged in each of the four corners of the bottom face 5*a* with a predetermined gap from the side walls 5*b*. In a central part of each side wall 5*b* of the tray 5, an elongated through hole 8*a* is formed.

The upper box 3 is in a rectangular columnar shape with its bottom part open, and covers the side faces and the top face of the article. Each side face of the upper box 3 has, in a lower part of it, a through hole 8*b* formed at a position overlapping the through hole 8*a* in the pallet-with-tray 2. With the through holes 8*a* and 8*b* overlapping each other, inserting the packing fastener 10 (see FIG. 2) in them permits the pallet-with-tray 2 and the upper box 3 to be coupled integrally together.

The shock absorber 4 is made of cardboard or foamed styrol and protects the article from external impact. The shock absorber 4 has an article placement face 4*a* formed so as to fit the shape of the article. In the bottom surface of the shock absorber 4, a cut-and-raised portion (not shown) provided on the bottom face 5*a* is inserted so that each shock absorber 4 can be positioned at a predetermined position with no displacement in the horizontal direction. The shock absorber 4 may be fixed on the bottom face 5*a* by any other method such as bonding.

The pallet 6 includes a plurality of support posts 6*a* formed, for example, by folding cardboard, and a top plate (not shown) and a bottom plate 6*b* that are fixed to the upper and lower faces of each support post 6*a*. Between every two adjacent support posts 6*a*, an arm insertion hole 9 is formed for inserting arms of a forklift or a hand pallet truck (pallet transport cart).

Next, a procedure for packing an article using the packing box 1 shown in FIG. 1 will be described. First, an article is placed on the article placement face 4*a* of the shock absorber 4 that is arranged on the bottom face 5*a* of the pallet-with-tray 2. Next, as necessary, a shock absorber is arranged also on the top and side faces of the article and, after covering the article with the upper box 3, the side walls 5*b* of the pallet-with-tray 2 are raised. Lastly, with the through hole 8*a* in the side wall 5*b* and the through hole 8*b* in the upper box 3 overlapping each other, the packing fastener 10 is inserted in them so that the pallet-with-tray 2 and the upper box 3 are coupled integrally together.

Figure 2:
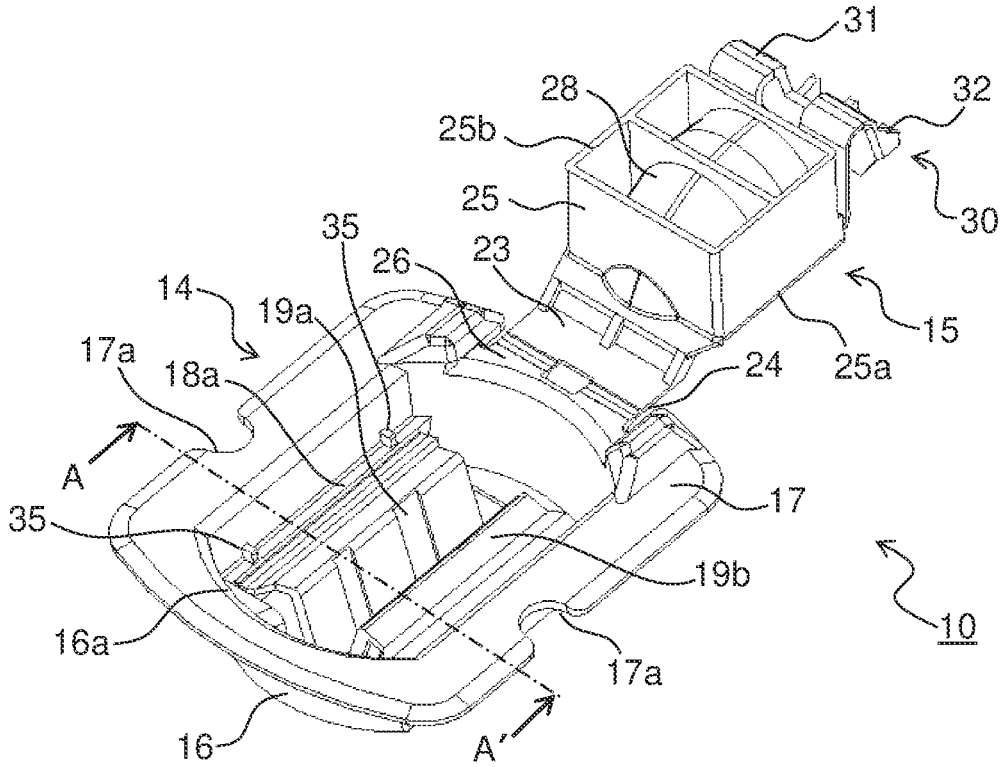
FIG. 2 is a perspective view of a packing fastener according to a first embodiment of the present disclosure in an unused state, as seen from a flange portion side.
Figure 3:
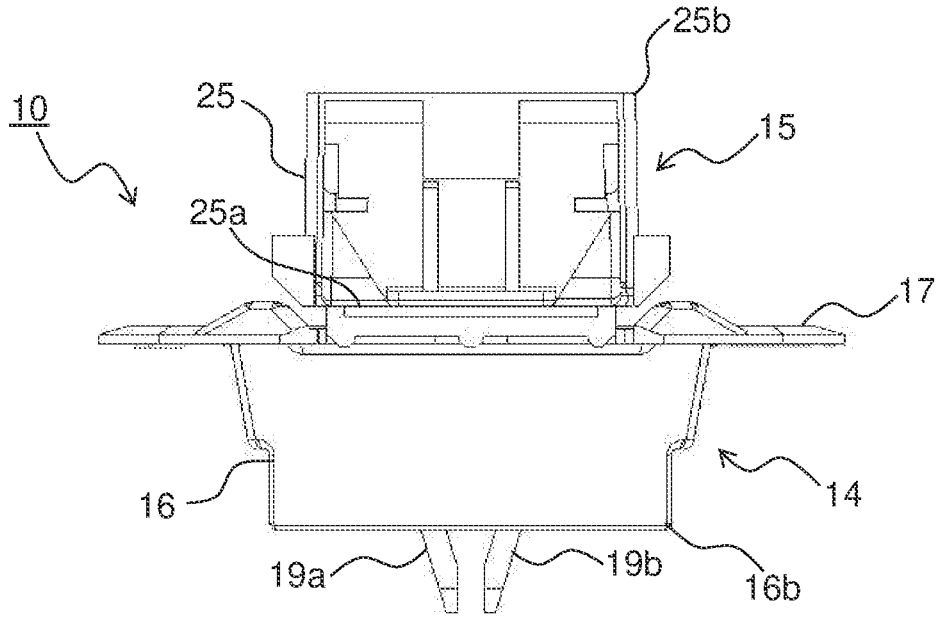
FIG. 3 is a side view of the packing fastener according to the first embodiment in an unused state, as seen from an extending direction of first hinge portions.
Figure 4:
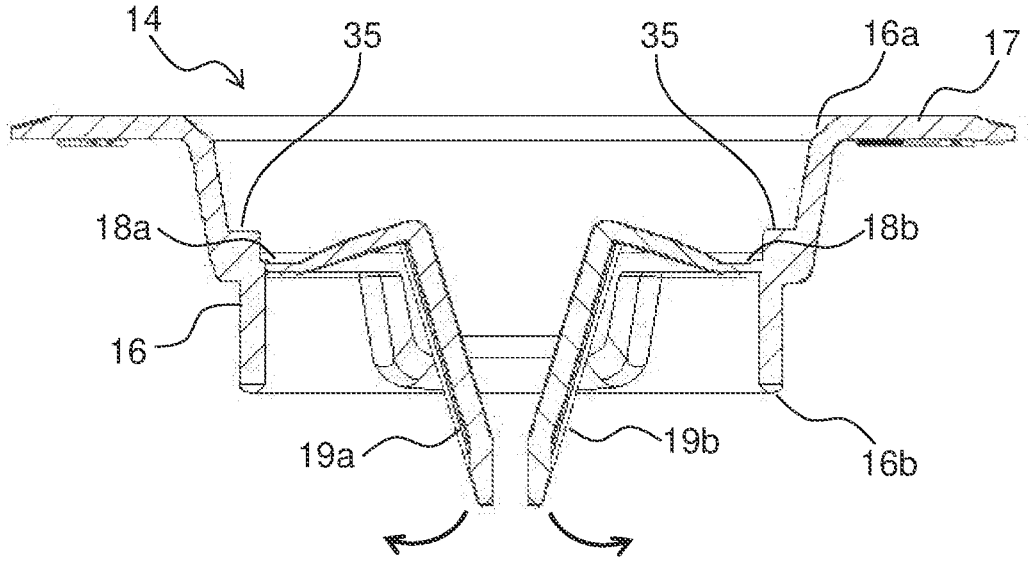
FIG. 4 is a side sectional view of a base member of the packing fastener according to the first embodiment as seen from the extending direction of the first hinge portions.

FIG. 2 is a perspective view of a packing fastener 10 according to a first embodiment of the present disclosure in an unused state, as seen from a flange portion 17 side (outside the packing box 1). FIG. 3 is a side view of the packing fastener 10 according to the first embodiment in an unused state, as seen from an extending direction of first hinge portions 18*a* and 18*b*. FIG. 4 is a side sectional view (as seen from the direction of arrows AA' in FIG. 2) of a base member 14 of the packing fastener 10 according to the first embodiment as seen from the extending direction of the first hinge portions 18*a* and 18*b*.

As shown in FIGS. 2 to 4, the packing fastener 10 includes the base member 14 and a key member 15 that is coupled to the base member 14 with a coupling piece 23. The base member 14 includes a first tubular portion 16, a flange portion 17 provided on a first opening edge 16*a* at one end of the first tubular portion 16, and a pair of hook members 19*a* and 19*b* that are pivotably coupled via the first hinge portions 18*a* and 18*b* to opposite inner side faces of the first tubular portion 16.

The flange portion 17 has formed in it a depressed portion 26 in which the coupling piece 23 of the key member 15 fits when the key member 15 is inserted in the base member 14. In the flange portion 17, a pair of pin holes 17*a* are formed in two sides parallel to the first hinge portions 18*a* and 18*b*. The pin hole 17*a* is semicircular so as to be open in an edge of the flange portion 17.

As shown in FIG. 4, the hook members 19*a* and 19*b* are each bent, about the first hinge portions 18*a* and 18*b* as hinge axes, outward of a second opening edge 16*b* at the other end of the first tubular portion 16, in an L-shape as seen in a sectional view, and the tip ends of the hook members 19*a* and 19*b* extend beyond the first tubular portion 16. Support ribs 35 are formed near the first hinge portions 18*a* and 18*b*. Pairs of support ribs 35 are formed at predetermined intervals in the extending direction of the first hinge portions 18*a* and 18*b* (the direction perpendicular to the plane of FIG. 4).

The key member 15 has a second tubular portion 25 with outer dimensions almost the same as the inner dimensions of the first tubular portion 16. Bending the coupling piece 23 along a second hinge portion 24 permits the second tubular portion 25 to be inserted in the first tubular portion 16 of the base member 14. The top face of the key member 15 has a first insertion section 27 (see FIG. 5) formed in it, and the bottom part of the first insertion section 27 has an inclined face 28 that is in an arc shape as seen in a sectional view.

An engaging portion 30 is provided on an edge opposite from the second hinge portion 24 of the key member 15. The engaging portion 30 includes a support portion 31 and a lock claw 32. The support portion 31 extends from, as a base end, a third opening edge 25*a* at one end of the second tubular portion 25 (upstream in the insertion direction) toward a fourth opening edge 25*b* at the other end in the insertion direction (upward in FIG. 2), and a tip end of the support portion 31 curves toward the base end (downward in FIG. 2) so as to be in a U-shape as seen in a side view.

A pair of lock claws 32 are formed near a tip end of the support portion 31, at opposite ends of it in an hinge axis direction (in the left-right direction in FIG. 3) of the second hinge portion 24 perpendicular to the extending direction of the support portion 31. When the second tubular portion 25 is inserted in the first tubular portion 16, the lock claw 32 engages with an engaged portion 40 (see FIG. 5) formed in an inner wall surface of the first tubular portion 16 of the base member 14. In this way, the key member 15 is locked with the second tubular portion 25 inserted in the first tubular portion 16 of the base member 14.

How coupling is achieved in the packing box 1 using the packing fastener 10 according to the first embodiment structured as described above will be described. First, with the through hole 8*a* in the side wall 5*b* of the pallet-with-tray 2 and the through hole 8*b* in the upper box 3 (for both, see FIG. 1) overlapping each other, from outside the side wall 5*b*, the base member 14 of the packing fastener 10 is inserted in the through holes 8*a* and 8*b* starting with the second opening edge 16*b* of the first tubular portion 16.

Next, from the state in FIG. 2, the key member 15 is pivoted about the second hinge portion 24 to be folded up toward the base member 14 so that the second tubular portion 25 makes contact with the hook members 19*a* and 19*b*. Then, the second tubular portion 25 is inserted in the first tubular portion 16 from the first opening edge 16*a* side. In this way, the hook members 19*a* and 19*b* are pressed by the second tubular portion 25, and the hook members 19*a* and 19*b* are pivoted outward of the first tubular portion 16 (in the directions indicated by arrows in FIG. 4) about the first hinge portions 18*a* and 18*b* as pivot shafts.

Figure 5:
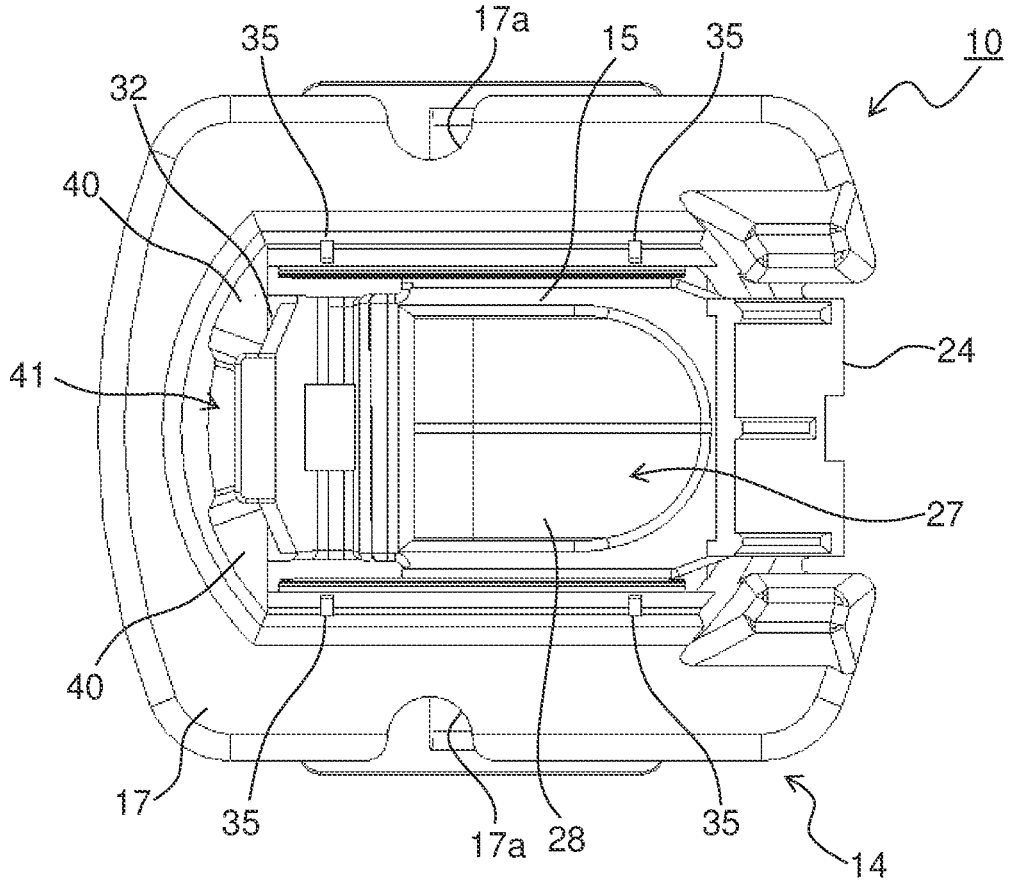
FIG. 5 is a plan view of the packing fastener according to the first embodiment as seen from the flange portion side, showing a state where a key member is inserted in a first tubular portion.
Figure 6:
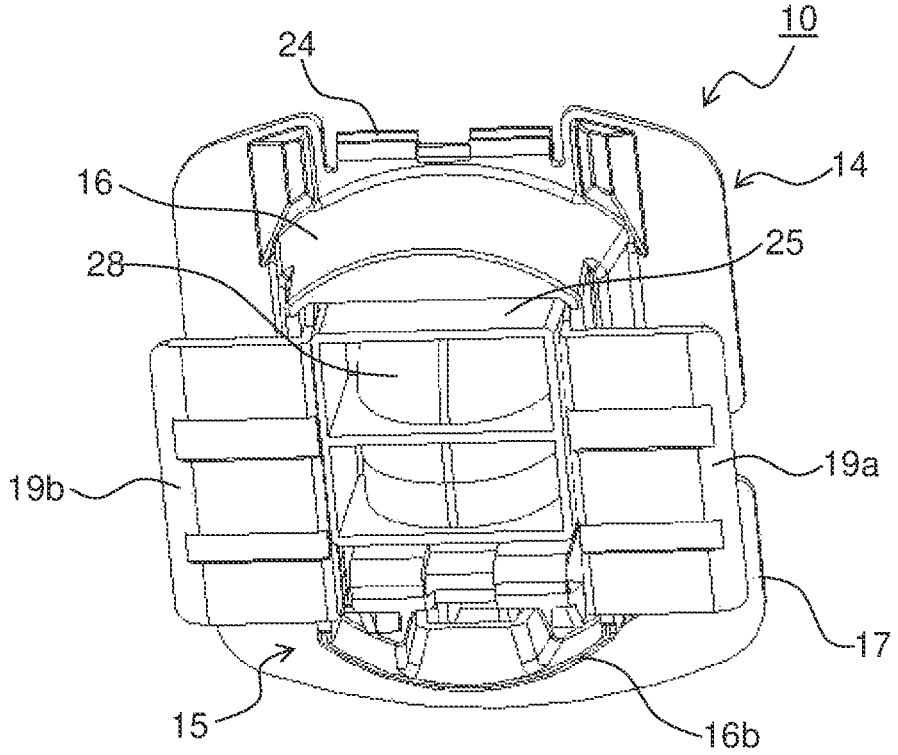
FIG. 6 is a perspective view of the packing fastener according to the first embodiment as seen from the hook member side, showing a state where the key member is inserted in the first tubular portion.
Figure 7:
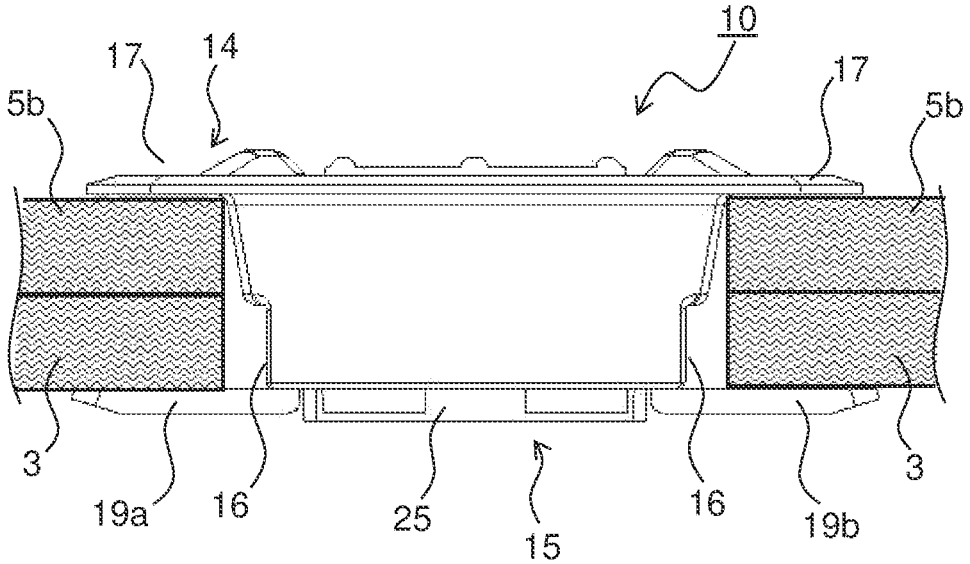
FIG. 7 is a side view of the packing fastener according to the first embodiment as seen from the extending direction of the first hinge portions, showing a state where the key member is inserted in the base member to hold the side wall of a pallet-with-tray and an upper box.

FIG. 5 is a plan view of the packing fastener 10 according to the first embodiment as seen from the flange portion 17 side, showing a state where the key member 15 is inserted in the base member 14. FIG. 6 is a perspective view of the packing fastener 10 according to the first embodiment as seen from the hook members 19*a* and 19*b* side, showing a state where the key member 15 is inserted in the base member 14. FIG. 7 is a side view of the packing fastener 10 according to the first embodiment as seen from the extending direction of the first hinge portions 18*a* and 18*b* (from left in FIG. 5), showing a state where the key member 15 is inserted in the base member 14 to hold the side wall 5*b* of the pallet-with-tray 2 and the upper box 3.

When the key member 15 (second tubular portion 25) is completely inserted in the base member 14 (first tubular portion 16), the tip ends of the hook members 19*a* and 19*b* pressed by the second tubular portion 25 project substantially parallel to the flange portion 17 out of the first tubular portion 16. Here, as shown in FIG. 7, the side wall 5*b* of the pallet-with-tray 2 and the upper box 3 are held between the flange portion 17 and the hook members 19*a* and 19*b*.

As shown in FIG. 7, in a state where the side wall 5*b* of the pallet-with-tray 2 is coupled to the upper box 3, when an external force that tends to make the hook members 19*a* and 19*b* pivot inward is applied, or, even when no external force is applied, a force that tends to make the hook members 19*a* and 19*b* pivot inward acts due to the restoring force of the first hinge portions 18*a* and 18*b*, and hence the second tubular portion 25 is pushed back by the hook members 19*a* and 19*b*. Thus, the key member 15 and the base member 14 may disengage from each other.

To avoid that, the engagement between the key member 15 and the base member 14 is maintained using the engaging portion 30 provided on the key member 15 and the engaged portion 40 provided in the base member 14. As the key member 15 is pivoted about the second hinge portion 24 and the second tubular portion 25 is inserted in the first tubular portion 16, the lock claw 32 runs on the engaged portion 40. This elastically deforms the support portion 31 in such a direction that the lock claw 32 recedes from the engaged portion 40.

When the hook members 19*a* and 19*b* pivot completely by being pressed by the second tubular portion 25, the lock claw 32 runs over the engaged portion 40, and the elastically deformed support portion 31 deforms due to its restoring force in such a direction that the lock claw 32 moves toward the engaged portion 40. In this way, as shown in FIG. 5, the lock claw 32 engages with a lower part of the engaged portion 40, so that the engagement between the key member 15 and the base member 14 can be firmly maintained.

To remove the packing fastener 10, the support portion 31 is elastically deformed in such a direction that the lock claw 32 recedes from the engaged portion 40, so that the lock claw 32 and the engaged portion 40 are disengaged from each other. Now the pallet-with-tray 2 can be separated from the upper box 3.

Figure 8:
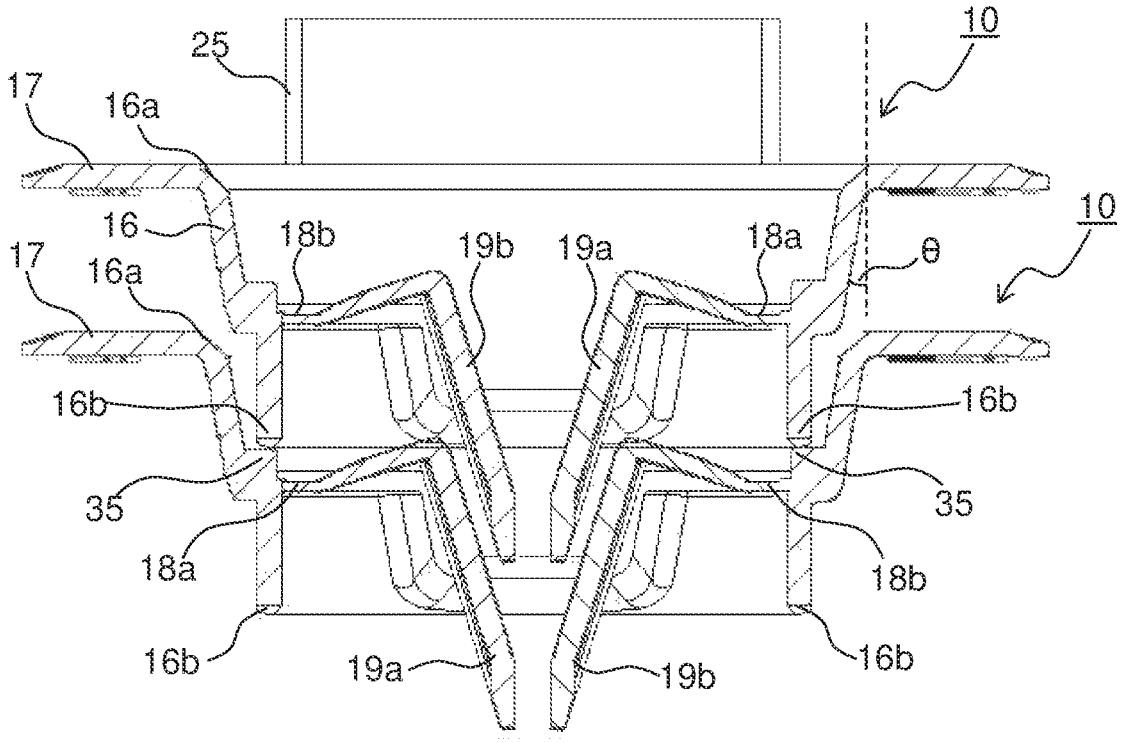
FIG. 8 is a side sectional view of two packing fasteners according to the first embodiment stacked on each other as seen from the extending direction of the first hinge portions.

FIG. 8 is a side sectional view of two packing fasteners 10 according to the first embodiment stacked on each other as seen from the extending direction of the first hinge portions 18*a* and 18*b*. As shown in FIG. 8, when the packing fasteners 10 are stacked on each other, the tip ends of the hook members 19*a* and 19*b* of the upper packing fastener 10 fit between the hook members 19*a* and 19*b* of the lower packing fastener 10. This helps restrict displacement of the stacked packing fasteners 10.

Here, the opposite hook members 19*a* and 19*b* are, with no external force applied to them, arranged in a wedge shape as seen in a sectional view so as to be increasingly close to each other toward the tip ends. Thus, the tip ends of the hook members 19*a* and 19*b* of the upper packing fastener 10 are guided along the hook members 19*a* and 19*b* of the lower packing fastener 10, so that that the packing fasteners 10 can be easily stacked on each other.

The side face of the first tubular portion 16 of the packing fastener 10 has a slope θ (10° in this embodiment) that is inclined inward from the first opening edge 16*a* toward the second opening edge 16*b*. That is, the outer diameter of the second opening edge 16*b* is smaller than that of the first opening edge 16*a*. Thus, when the packing fasteners 10 are stacked on each other, the second opening edge 16*b* (bottom end) of the upper packing fastener 10 can be smoothly inserted in the first opening edge 16*a* of the lower packing fastener 10.

The slope θ is not limited to 10°, but if θ is too small, it is difficult to stack the packing fasteners 10 together. On the other hand, if θ is too large, the packing fasteners 10 sit unstably when stacked together. Thus, θ is preferably 5° to 15°.

Furthermore, when the packing fasteners 10 are stacked together, the second opening edge 16*b* of the upper packing fastener 10 makes contact with the support ribs 35 on the lower packing fastener 10. Here, the outer side face of the upper first tubular portion 16 and the inner side face of the lower first tubular portion 16, and also the upper hook members 19*a* and 19*b* and the lower hook members 19*a* and 19*b*, are kept away from each other. Thus, it is possible to prevent the packing fasteners 10 from making so close contact with each other as to become inseparable due to a dimensional error caused by warping during molding of the packing fastener 10, shrinkage caused by a temperature change, or the like.

Figure 9:
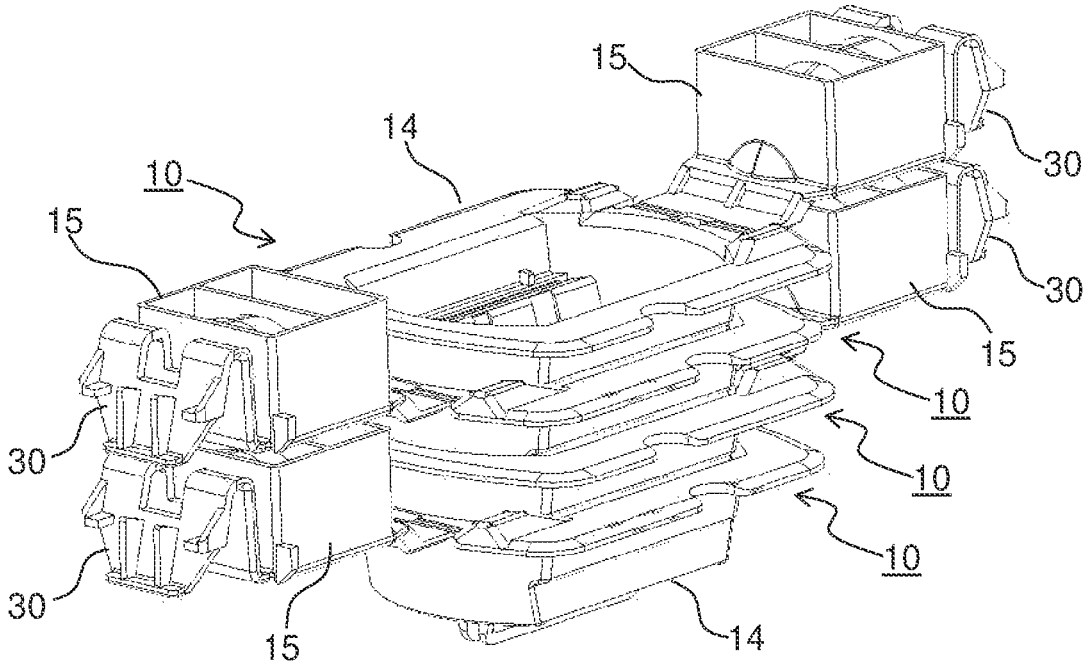
FIG. 9 is a perspective view showing a state where four packing fasteners of the first embodiment are stacked together.

FIG. 9 is a perspective view showing a state where four packing fasteners 10 of the first embodiment are stacked together. As shown in FIG. 9, two packing fasteners 10 are stacked together with the upper one 10 rotated 180° with respect to the lower one 10. Thus, two key members 15 adjacent in the up-down direction project from the base members 14 in alternate directions, and this helps prevent, when the packing fasteners 10 are stacked together, two key members 15 adjacent in the up-down direction from interfering with each other.

Figure 10:
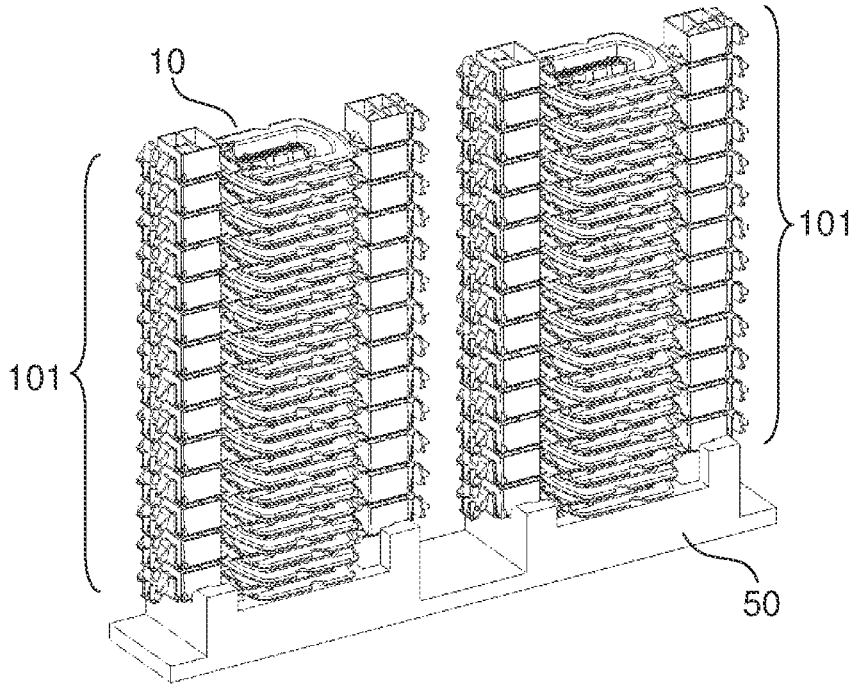
FIG. 10 is a perspective view showing a state where a fastener bundle with a number of packing fasteners of the first embodiment stacked together is placed on a support stand.
Figure 11:
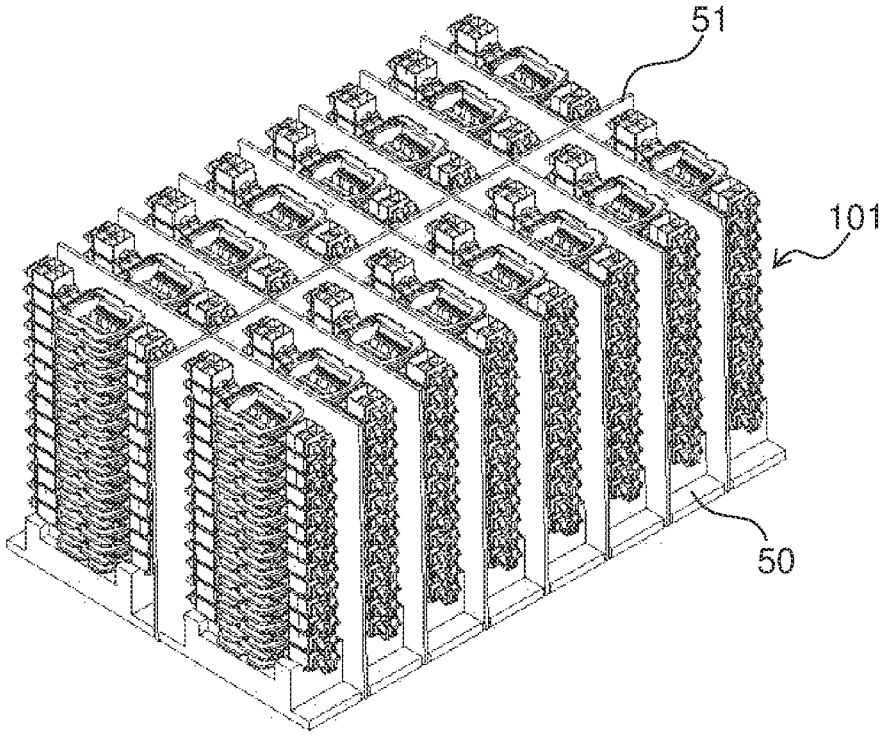
FIG. 11 is a perspective view showing a state where fastener bundles are placed on a plurality of support stands partitioned by partition boards.
Figure 12:
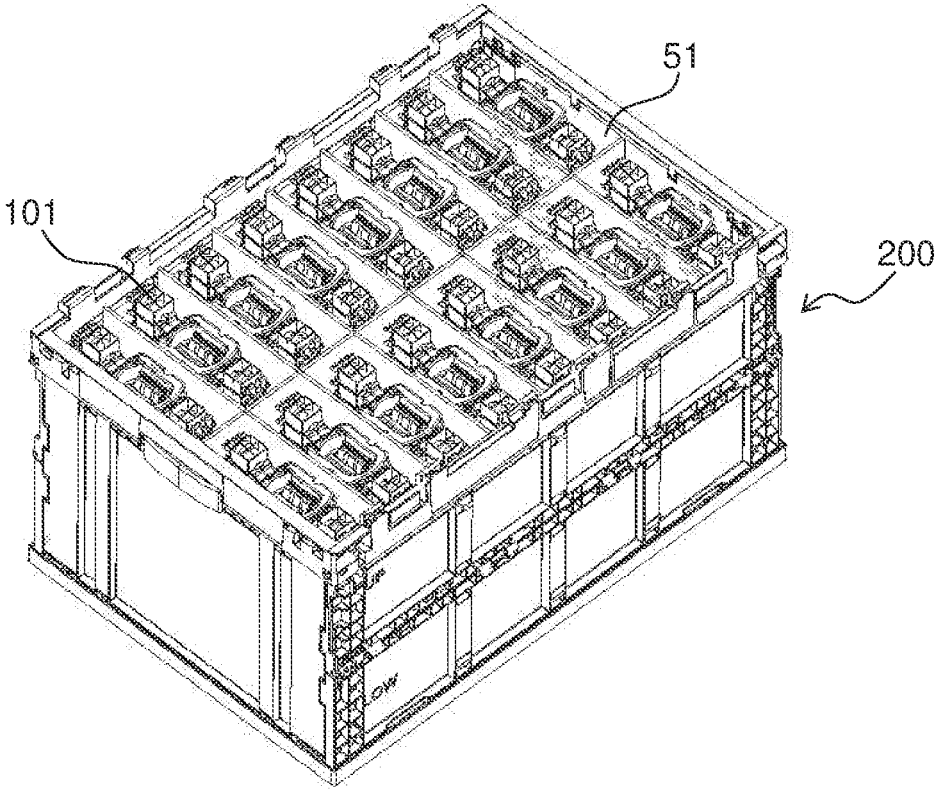
FIG. 12 is a perspective view showing a state where the fastener bundles placed on support stands are stored in a transportation container.

Next, how the packing fastener 10 of the first embodiment is transported will be described. FIG. 10 is a perspective view showing a state where a fastener bundle 101 with a number of packing fasteners 10 of the first embodiment stacked together is placed on a support stand 50. FIG. 11 is a perspective view showing a state where fastener bundles 101 are placed on a plurality of support stands 50 partitioned by partition boards 51. FIG. 12 is a perspective view showing a state where the fastener bundles 101 placed on support stands 50 are stored in a transportation container 200.

As shown in FIGS. 10 to 12, placing fastener bundles 101 having a plurality of packing fasteners 10 stacked together on support stands 50 and storing these in a transportation container 200, as compared with randomly putting packing fasteners 10 in a bag, helps reduce the transportation space for the packing fastener 10. In addition, there is no risk of the packing fasteners 10 tangling or being damaged due to vibration or impact during transportation.

Figure 13:
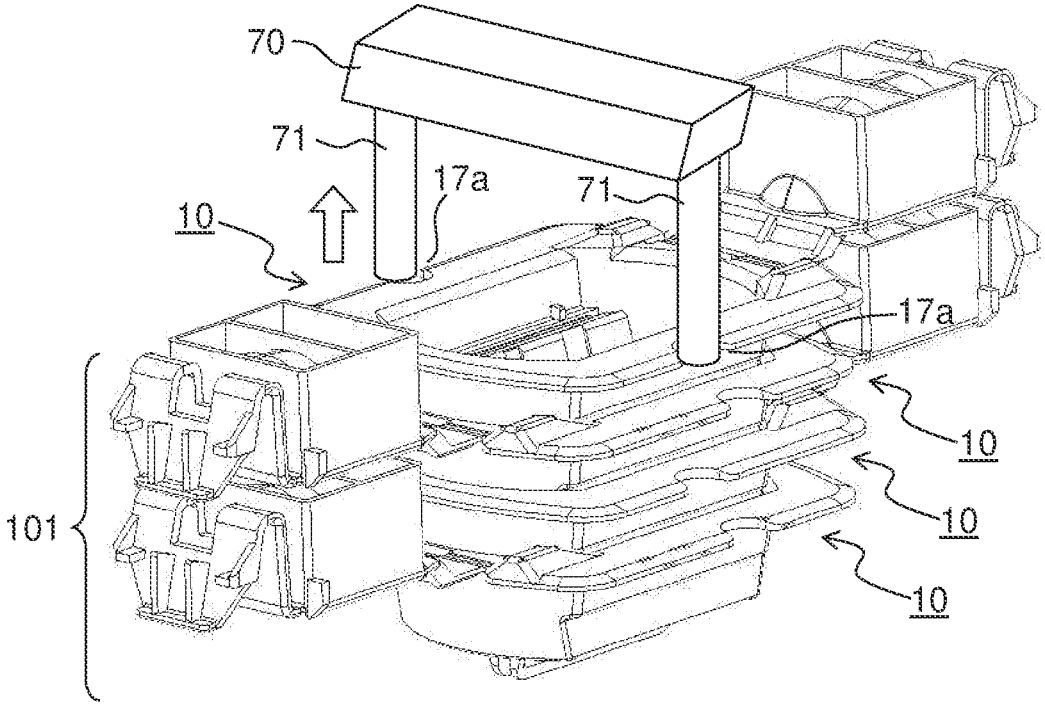
FIG. 13 is a perspective view showing how pins of a parts feeder are inserted in pin holes in the topmost packing fastener in the fastener bundle to pick up the packing fastener.

When the packing fasteners 10 are dispensed using automated assembly equipment (parts feeder), as shown in FIG. 13, two pins 71 of the parts feeder 70 are inserted in a pair of pin holes 17*a* in the topmost packing fastener 10 in the fastener bundle 101. Then, the pins 71 are moved inward to hold the packing fastener 10 from opposite sides, and then the pins 71 are lifted up to pick up the packing fastener 10. In this way, the packing fastener 10 can be restrained in a horizontal position while being smoothly unstacked to be dispensed from the fastener bundle 101 one by one.

With the packing fastener 10 of this embodiment, it is possible to hold a number of packing fasteners 10 in a stacked state without their making close contact with each other. Thus, it is possible to reduce transportation space, and this improves transportation efficiency. It is also possible to pick up the packing fastener 10 using automated assembly equipment, and this improves ease of packing using the packing fastener 10.

Figure 14:
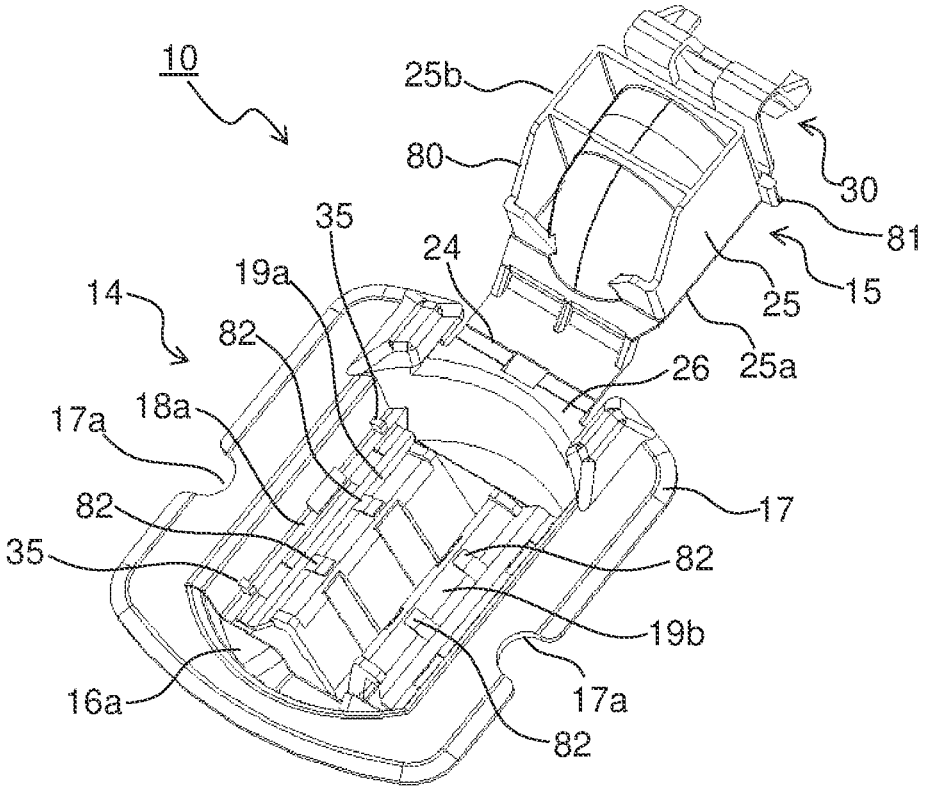
FIG. 14 is a perspective view of a packing fastener according to a second embodiment of the present disclosure in an unused state, as seen from the flange portion side.
Figure 15:
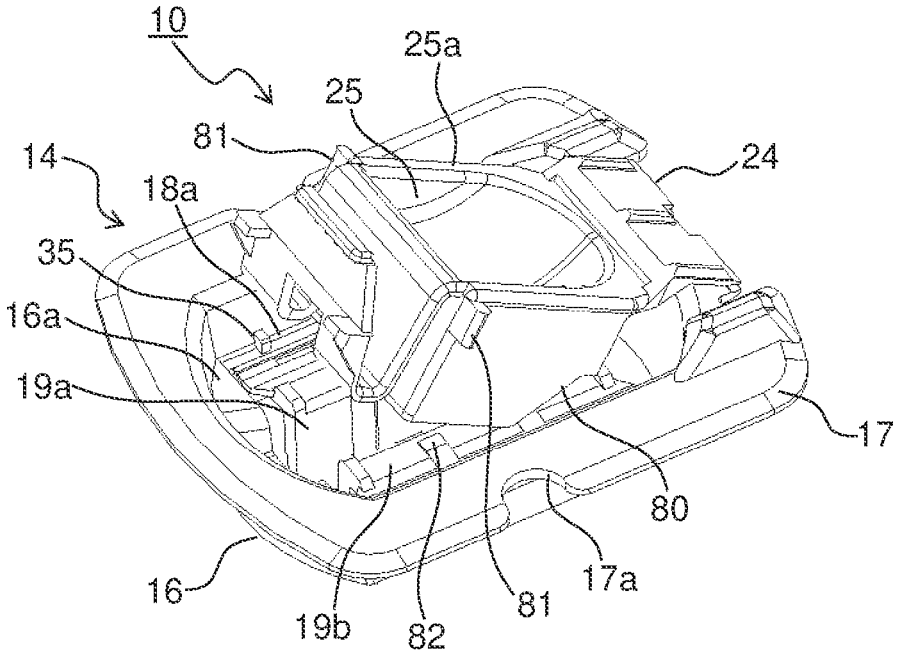
FIG. 15 is a perspective view of the packing fastener according to the second embodiment as seen from the flange portion side immediately before the key member is inserted in the first tubular portion.
Figure 16:
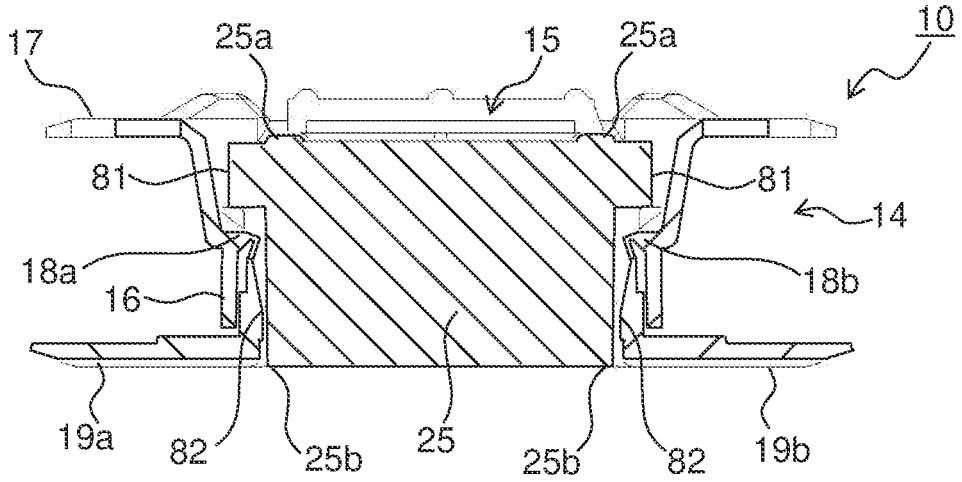
FIG. 16 is a side sectional view of the packing fastener according to the second embodiment as seen from the extending direction of the first hinge portions, showing a state where the key member is inserted in the first tubular portion.

FIG. 14 is a perspective view of a packing fastener 10 according to a second embodiment of the present disclosure in an unused state, as seen from the flange portion 17 side. FIG. 15 is a perspective view of the packing fastener 10 according to the second embodiment as seen from the flange portion 17 side immediately before the key member 15 is inserted in the first tubular portion 16. FIG. 16 is a side sectional view of the packing fastener 10 according to the second embodiment as seen from the extending direction of the first hinge portions 18*a* and 18*b*, showing a state where the key member 15 is inserted in the first tubular portion 16.

In the packing fastener 10 of this embodiment, an inclined face 80 is formed on the second tubular portion 25 of the key member 15. On the outer side face of the second tubular portion 25, restricting projections 81 are formed. Furthermore, contact ribs 82 are formed on the hook members 19*a* and 19*b* on their faces opposite the second tubular portion 25. In other respects, the packing fastener 10 is configured similarly to that of the first embodiment.

As shown in FIGS. 14 and 15, the inclined face 80 is so inclined as to be increasingly far away from the third opening edge 25*a* and close to the fourth opening edge 25*b* (downward in FIG. 15) in a direction from the second hinge portion 24 side to the engaging portion 30 side (pivot end side) of the second tubular portion 25, eventually reaching the fourth opening edge 25*b*. Forming the inclined face 80 on the second tubular portion 25 reduces the contact area between the fourth opening edge 25*b* and the hook members 19*a* and 19*b* when the second tubular portion 25 is inserted in the first tubular portion 16. More specifically, the fourth opening edge 25*b* makes contact only with middle parts of the hook members 19*a* and 19*b* in the longitudinal direction (the extending direction of the first hinge portions 18*a* and 18*b*).

In this way, when the second tubular portion 25 is inserted in the first tubular portion 16, the load from the second tubular portion 25 is applied only to middle parts of the hook members 19*a* and 19*b* in the longitudinal direction. Thus, it is possible to reduce the load needed to open and close the hook members 19*a* and 19*b*, and this improves the operability of the packing fastener 10.

As shown in FIGS. 15 and 16, a pair of restricting projections 81 are formed near the third opening edge 25*a* of the second tubular portion 25 at the engaging portion 30 side (pivot end side), along the extending direction of the first hinge portions 18*a* and 18*b*. When the second tubular portion 25 is inserted in the first tubular portion 16, the pair of restricting projections 81 face the top faces of the first hinge portions 18*a* and 18*b*.

When the second tubular portion 25 is inserted in the first tubular portion 16 up to a predetermined position, the restricting projections 81 and the top faces (restriction faces) of the first hinge portions 18*a* and 18*b* make contact with each other to restrict insertion of the second tubular portion 25. This prevents the second tubular portion 25 from being pushed into the first tubular portion 16 too far; thus, it is possible to prevent deformation of or damage to the packing fastener 10.

As shown in FIG. 16, the contact ribs 82 are, with the second tubular portion 25 inserted in the first tubular portion 16, formed on the faces of the hook members 19*a* and 19*b* facing the second tubular portion 25. As shown in FIG. 14, two contact ribs 82 are formed on each of the hook members 19*a* and 19*b*; that is, a total of four of them are formed.

With the packing fastener 10 in an attached state as in FIG. 16, a load may be applied to the hook members 19*a* and 19*b* in such a direction as to release the packing fastener 10 from the attached state (for the hook member 19*a*, counterclockwise in FIG. 16 and, for the hook member 19*b*, clockwise in FIG. 16). In this case, if a force acts in such a direction as to push up the fourth opening edge 25*b* of the second tubular portion 25 from the hook members 19*a* and 19*b*, the second tubular portion 25 may fall out of the first tubular portion 16, releasing the packing fastener 10 from the attached state.

However, forming the contact ribs 82 on the faces of the hook members 19*a* and 19*b* facing the second tubular portion 25 prevents the fourth opening edge 25*b* of the second tubular portion 25 from making contact with the hook members 19*a* and 19*b*. Thus, even if a load is applied to the hook members 19*a* and 19*b* in a direction for release from the attached state, no force acts in such a direction as to push up the fourth opening edge 25*b* of the second tubular portion 25. Thus, it is possible to prevent the packing fastener 10 from being released from the attached state unintendedly.

The embodiments described above are in no way meant to limit the present disclosure, which thus allow for many modifications and variations within the spirit of the present disclosure. For example, while, in the first embodiment described above, two support ribs 35 are formed across a predetermined interval along the extending direction of the first hinge portions 18*a* and 18*b* (the direction perpendicular to the plane of FIG. 4), three or more support ribs 35 may be formed along the extending direction of the first hinge portions 18*a* and 18*b*.

While, in the second embodiment described above, the top faces of the first hinge portions 18*a* and 18*b* serve as the restriction faces that make contact with the restricting projections 81, restriction faces that make contact with the restricting projections 81 may be arranged separately from the first hinge portions 18*a* and 18*b*.

While the embodiments described above deal with a packing fastener 10 used in a packing box 1 that uses a pallet-with-tray 2 including a tray 5 and a pallet 6, needless to say, a packing fastener 10 of the present disclosure is applicable similarly to a packing box 1 that includes only an upper box 3 and a tray 5 without a pallet 6.

The present disclosure finds applications in packing fasteners that are inserted in overlapping holes in two or more separate pieces of a packing material, such as cardboard sheets, so as to couple together those pieces. Based on the present disclosure, it is possible to provide a packing fastener that can improve transportation and dispensing efficiency, as well as to provide a packing box that is coupled together using such a packing fastener.

What is claimed is:

1. A packing fastener, comprising:

a base member including:

a first tubular portion that is inserted in overlapping through holes formed in two or more pieces of a packing material;

a flange portion that is provided on a first opening edge of the first tubular portion at one end thereof;

a pair of hook members that are coupled via first hinge portions to opposite inner side faces of the first tubular portion, the pair of hook members being bendable, about the first hinge portions as hinge axes, outward of a second opening edge of the first tubular portion at another end thereof; and a key member that has a second tubular portion that is removably insertable in the first tubular portion of the base member via the first opening edge, the key member being coupled to the flange portion via a second hinge portion perpendicular to the first hinge portions, the first tubular portion being inserted in the through holes starting with the second opening edge and then the second tubular portion being inserted in the first tubular portion so that the hook members pivot about the first hinge portions as hinge axes toward the second opening edge of the first tubular portion to project out beyond the second opening edge so as to face the flange portion, resulting in the two or more pieces of the packing material being held between the flange portion and the hook member, wherein the pair of hook members are, with no external force applied thereto, arranged in a wedge shape as seen in a sectional view so as to be increasingly close to each other toward tip ends, and each of outer side faces of the first tubular portion has a slope that is inclined inward from the first opening edge toward the second opening edge.

2. The packing fastener according to claim 1, wherein the slope is 5° to 15°.

3. The packing fastener according to claim 1, wherein near the first hinge portion, a support rib is formed with which, when the packing fasteners are stacked together, the second opening edge of the upper packing fastener makes contact, and when the second opening edge of the upper packing fastener makes contact with the support rib on the lower packing fastener, the outer side faces of the upper first tubular portion and inner side faces of the lower first tubular portion are kept away from each other, and the upper hook members and the lower hook members are kept away from each other.

4. The packing fastener according to claim 3, wherein, two or more of the support ribs are formed at a predetermined interval in an extending direction of the first hinge portions.

5. The packing fastener according to claim 1, wherein in two sides of the flange portion parallel to the first hinge portions, a pair of pin holes in which pins of a parts feeder are inserted are formed.

6. The packing fastener according to claim 1, wherein the key member includes an engaging portion that locks the second tubular portion inserted in the first tubular portion, and the engaging portion includes:

an elastically deformable support portion that is in a U-shape as seen in a side view, and a lock claw that is formed on the support portion and that engages with an engaged portion formed in the inner side face of the first tubular portion.

7. The packing fastener according to claim 1, wherein the second tubular portion has a third opening edge upstream in an insertion direction of the second tubular portion with respect to the first tubular portion and a fourth opening edge downstream in the insertion direction, and the second tubular portion has formed thereon an inclined face that is so inclined as to be increasingly far away from the third opening edge and close to the fourth opening edge in a direction from a second hinge portion side to a pivot end side of the key member, eventually reaching the fourth opening edge.

8. The packing fastener according to claim 1, wherein, a restricting projection is formed on an outer side face of the second tubular portion, and on the first tubular portion, a restriction face that makes contact with the restricting projection when the second tubular portion is inserted up to a predetermined position is formed.

9. The packing fastener according to claim 1, wherein on each of the pair of hook members, a contact rib is formed that makes contact with an outer side face of the second tubular portion inserted in the first tubular portion.

10. A packing box that is coupled together using the packing fastener according to claim 1.

* * * * *